US005741150A

United States Patent [19]

Stinson et al.

[11] Patent Number: 5,741,150

[45] Date of Patent: Apr. 21, 1998

[54] UNITARY SPRING LATCH FOR AN ELECTRICAL CONNECTOR ASSEMBLY

[75] Inventors: James Christopher Stinson, Roanoke; Thomas Leon Fix, Buena Vista, both of Va.

[73] Assignee: The Whitaker Corporation, Wilmington, Del.

[21] Appl. No.: 770,105

[22] Filed: Dec. 19, 1996

[51] Int. Cl.[6] ..... H01R 13/627

[52] U.S. Cl. ..... 439/358; 439/157

[58] Field of Search ..... 439/350–358, 439/372, 152, 157–160

[56] References Cited

U.S. PATENT DOCUMENTS

| | | | |
|---|---|---|---|
| 4,367,003 | 1/1983 | Frantz . | |
| 4,568,135 | 2/1986 | Frantz . | |
| 5,383,794 | 1/1995 | Davis et al. | 439/352 |
| 5,494,452 | 2/1996 | Matsumoto et al. | 439/358 |

OTHER PUBLICATIONS

*Cory CQ Connector Disclosure*, five pages; Jan. 1996; Cory Components Inc., El Segundo, CA.

*Primary Examiner*—Khiem Nguyen

*Attorney, Agent, or Firm*—Anton P. Ness

[57] ABSTRACT

An electrical connector assembly having unitary spring latches for latching the assembly to a mating connector and for assisting in the separation of the assembly from the connector. The mating connector is associated with a latch post having an enlarged head at its forward end. The spring latch includes an engagement end adapted for engagement with the latch post behind the enlarged head and an actuating end at the opposite end of the spring latch across an integral pivot adapted for operator manipulation to release the engagement end from engagement with the latch post. The spring latch further includes integral biasing means for biasing the actuating end in a direction to effect engagement of the engagement end with the latch post and a spring arm which bears against the forward end of the latch post to provide a yieldable biasing force to the latch post in a direction to oppose mating of the assembly with the connector and to aid in separation of the assembly from the connector.

6 Claims, 3 Drawing Sheets

UNITARY SPRING LATCH FOR AN ELECTRICAL CONNECTOR ASSEMBLY

FIELD OF THE INVENTION

This invention relates to an electrical connector assembly and, more particularly, to an improved unitary spring latch for latching the assembly to a mating connector and for assisting in the unlatching therefrom.

BACKGROUND OF THE INVENTION

An electrical connector assembly manufactured by Cory Components, Inc., includes a latch assembly for a connector which engages with a latch post of a mating connector. In addition, the latch assembly includes means for aiding in the ejection of the latch post from the connector when disengagement is desired. However, this latching assembly comprises four pieces, i.e., a spring arm, a latching claw, a pivot pin and a coil ejector spring. It would be desirable to provide a unitary spring latch providing all of the above functions.

U.S. Pat. No. 5,383,794 discloses an electrical connector assembly having an actuator mechanism for a pair of unitary spring latch arms. The pair of latch arms flank a connector and together therewith are contained within a holder, with actuating ends of the latch arms extending laterally outward from the holder. The actuator mechanism surrounds the holder and is slidable therealong. The latch arms are adapted to engage with, and to pivot and disengage from, latch posts of a mating electrical connector. Sliding the actuator mechanism along the holder away from the mating connector engages the actuating ends of the latch arms to pivot the latch arms to disengage from the mating connector latch posts and separates the two connectors. It would be desirable to provide a connector assembly having unitary spring latch arms which does not require such an actuator mechanism, but at the same time provides an aid to separating the mating connectors.

SUMMARY OF THE INVENTION

The foregoing and additional objects are attained in accordance with the principles of this invention by providing an electrical connector assembly adapted for mating connection with a mating connector having a latch post extending along the direction of relative linear movement between the connector assembly and the mating connector during mating/unmating, the latch post having an enlarged head at its forward end. The inventive assembly comprises a primary connector supporting a plurality of electrical terminals exposed along the mating face of the primary connector and a two-part housing with an interior cavity adapted to encircle and contain the primary connector such that the mating face is accessible from outside the housing along the forward end of the housing. The housing further has its cavity open to the housing forward end for receiving the latch posts therein, preferably to each side of the primary connector. A unitary spring latch is supported within the housing along each side of the primary connector for pivotal movement about a pivot axis orthogonal to the direction of relative linear movement. Each spring latch includes an engagement end extending into a latch post receiving cavity and adapted for engagement with a respective latch post behind its enlarged head, and an actuating end across the pivot axis from the engagement end and extending outwardly from the housing. The actuating end of each spring latch is adapted for inward pivoting movement to release the engagement end from engagement with its latch post. Each spring latch further includes biasing means for yieldably biasing the actuating end outwardly from the housing, and a spring arm extending into the latch post receiving cavity and adapted to bear against the forward end of the latch post. The spring arm provides a yieldable biasing force to the latch post in a direction outwardly from the latch post receiving cavity, to aid ejection of the latch post from the latch post receiving cavity.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
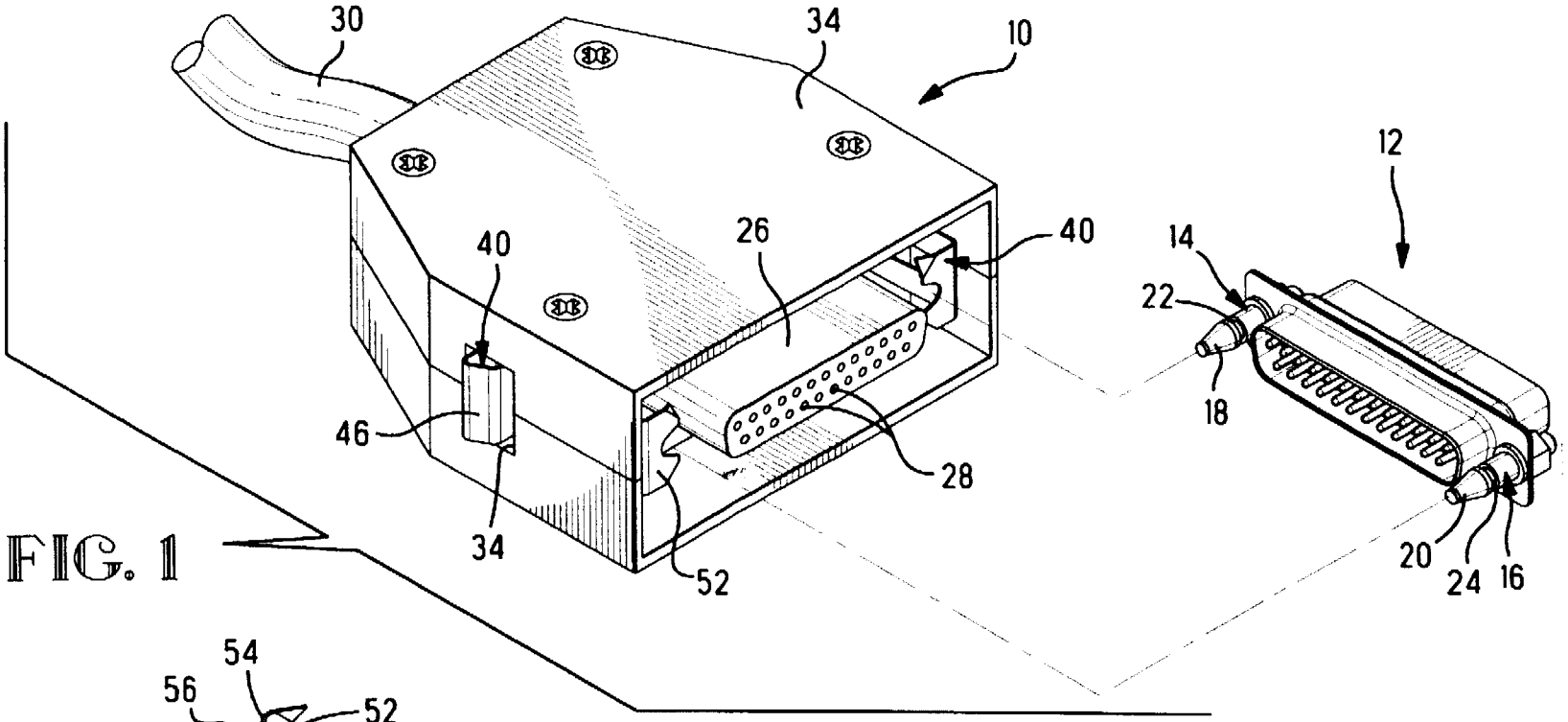
FIG. 1 is an isometric view of an electrical connector assembly according to this invention and a mating connector.

Referring now to the drawings, FIG. 1 illustrates an electrical connector assembly designated generally by the reference numeral 10 and incorporating the unitary spring latch constructed according to this invention. The assembly 10 is adapted for mating connection with a mating connector 12 which has a pair of latch posts 14, 16 which extend along the direction of relative linear movement between the assembly 10 and the connector 12 during mating/unmating. Each of the latch posts 14, 16 has a respective enlarged head 18, 20 at its forward end. The enlarged heads 18, 20 taper outwardly from their forward ends and then step inwardly so that behind each of the enlarged heads 18, 20 there is a reduced width shaft portion 22, 24.

The connector assembly 10 includes a primary connector 26 of conventional design which supports a plurality of electrical terminals 28 exposed along a forward side of the connector 26. The terminals 28 are connected to individual wires within the cable 30 which extends rearwardly from the connector assembly 10. The connector assembly 10 further includes a two-part housing 32, illustratively but not necessarily of hermaphroditic construction, which has an interior cavity adapted to encircle and contain the connector 26 and allow the connector mating face at the forward end of the connector 26 to be accessible from outside the housing 32 along the forward end thereof. As shown, the connector 26 extends outwardly from the housing 32, it being understood that the connector 26 could also be completely contained within the housing 32 so long as the terminals 28 remain accessible. The housing 32 further has an interior cavity open to the forward end and exposing the connector mating face. The cavity receives the latch posts 18, 20 therein to each side of the connector 26. This cavity may be the same as the cavity containing the connector 26, as illustrated.

Figure 2:
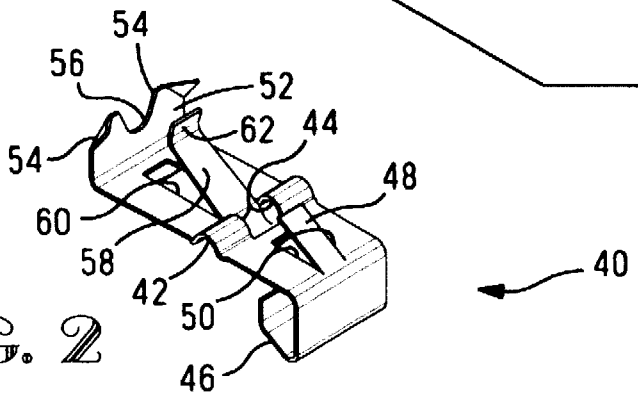
FIG. 2 is an isometric view of a unitary spring latch constructed according to this invention.

According to the present invention, a unitary spring latch, designated generally by the reference numeral 40 and shown in FIG. 2, is provided. The spring latch 40 is stamped and formed from a metal blank to be of unitary construction. A circular pivot 42 is formed by oppositely curved strips being bent outwardly from the plane of thickness of the metal blank. The side edges of the strips are defined by adjacent, spaced apart, longitudinal slits 44 extending lengthwise through the blank. The actuating end 46 of the latch 40 is formed into a loop, by bending the blank on itself. The actuating end 46 projects from the pivot 42 in a rearward direction and extends outwardly from an opening 34 in the housing 32.

Biasing means including a first spring arm 48 extends from the actuating end 46, at an angle to the metal blank, and is cut out from the metal blank by slits 50 in the blank defining three of the four sides of the spring arm 48. The engagement end 52 of the latch 40 extends away from the pivot 42 in the opposite direction from the actuating end 46, and is bent at its forward end oppositely to the direction formed by the loop of the actuating end 46. The far end of the engagement end 52 is formed with a pair of spaced fingers 54, shown as being separated by a semicircular cut out 56. The spacing between the fingers 54 is greater than the width of the reduced width shaft portions 22, 24 of the latch posts 14, 16 and less than the width of the rearward end of the enlarged heads 18, 20. Preferably, the diameter of the cut out 56 is slightly greater than the diameter of the reduced width shaft portions 22, 24.

The latch 40 further includes a second spring arm 58 extending forwardly from the pivot 42 and formed by slits 60 cut into the metal blank and defining three of the four sides of the spring arm 58. The spring arm 58 extends from the metal blank diagonally toward the same side as the bent forward end of the engagement end 52. At its forward end 62, the spring arm 58 is bent at a substantially right angle. This right angle bend is substantially directly above the cut out 56.

Figure 3:
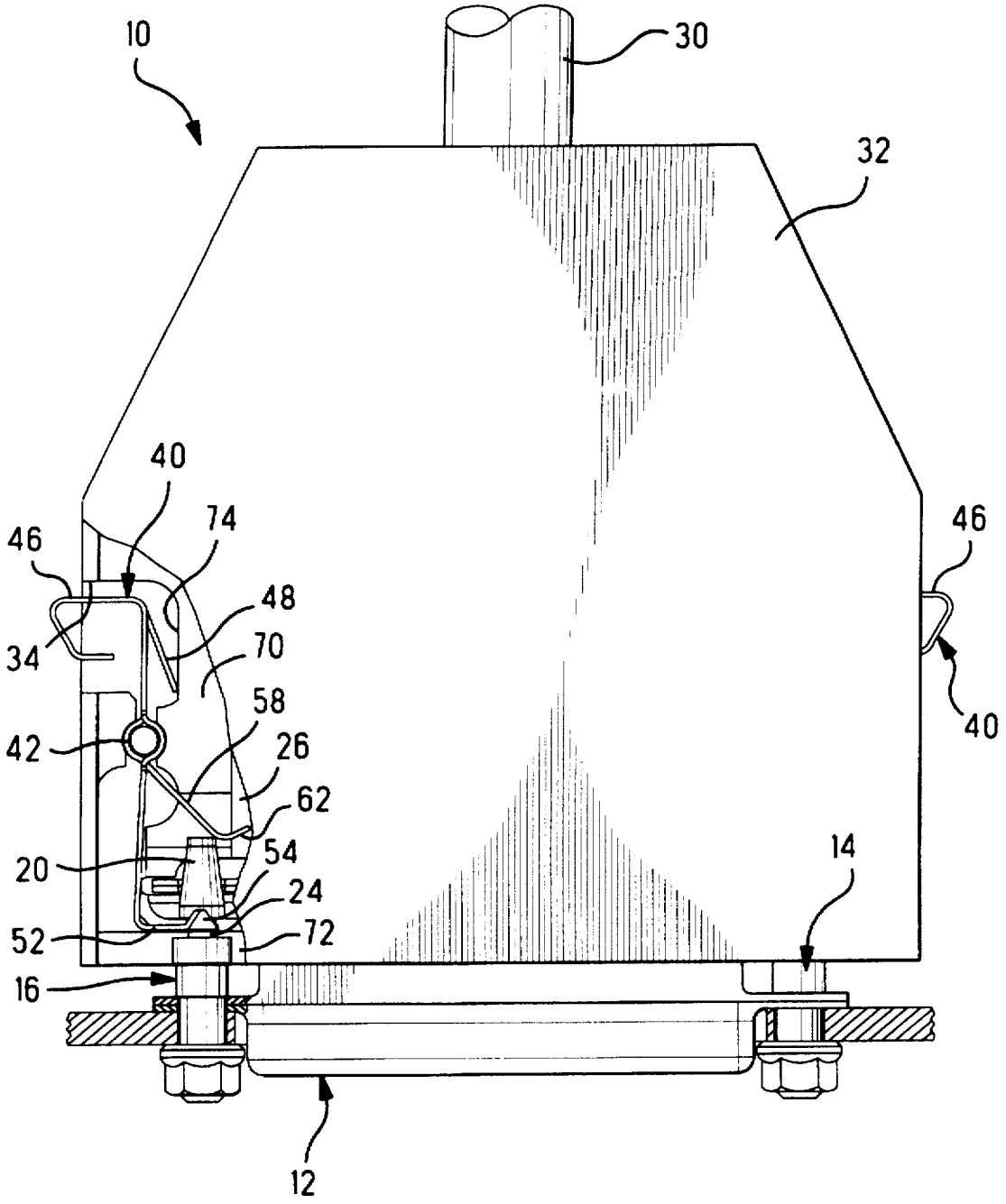
FIG. 3 is a partially cut away plan view showing the inventive electrical connector assembly mated to the mating connector with the latch post of the mating connector engaged by the inventive spring latch.

As shown in FIG. 3, the housing 32 has an interior cavity 70 for holding the connector 26. Separate cavities 72 on opposite sides of the housing 32 allow a pair of identical spring latches 40 to be dropped therein, with their orientations being the mirror images of each other. Thus, the spring latch 40 is dropped into the cavity 72 with its actuating end 46 extending outwardly through the opening 34 and its engagement end 52 extending toward the connector 26. The spring arm 48 extends toward the inner wall 74 of the cavity 72 and is effective to yieldably bias the actuating end 46 outwardly of the housing 32 through the opening 34. At the same time, the engagement end 52 is biased inwardly of the housing 32.

When the connector 26 is to be mated with the connector 12, the two connectors are brought together. At that time, the latch posts 14, 16 enter the open forward end of the housing 32. The taper of the enlarged heads 18, 20 causes the engagement ends 52 of the spring latches 40 to deflect outwardly out of the path of the latch posts 14, 16. When an enlarged head passes an engagement end, the engagement end snaps behind the enlarged head with the finger 54 flanking the reduced width shaft portion and the cut out 56 bearing against the reduced width shaft portion. This provides a positive lock to prevent inadvertent separation of the connectors 12, 26. The forward end 62 of the spring arm 58 is spaced from the fingers 54 a distance which is slightly less than the front to rear dimension of the enlarged head 18 so that the forward end of the latch post 14 deflects the spring arm 58 rearwardly from its neutral position. Thus, the enlarged head 18 is firmly seated between the fingers 54 of the engagement end 52 and the forward end 62 of the spring arm 58. Thus, the spring arm 58 provides a yieldable biasing force to the latch post 14 in a direction outwardly from the cavity of the housing 32.

Figure 4:
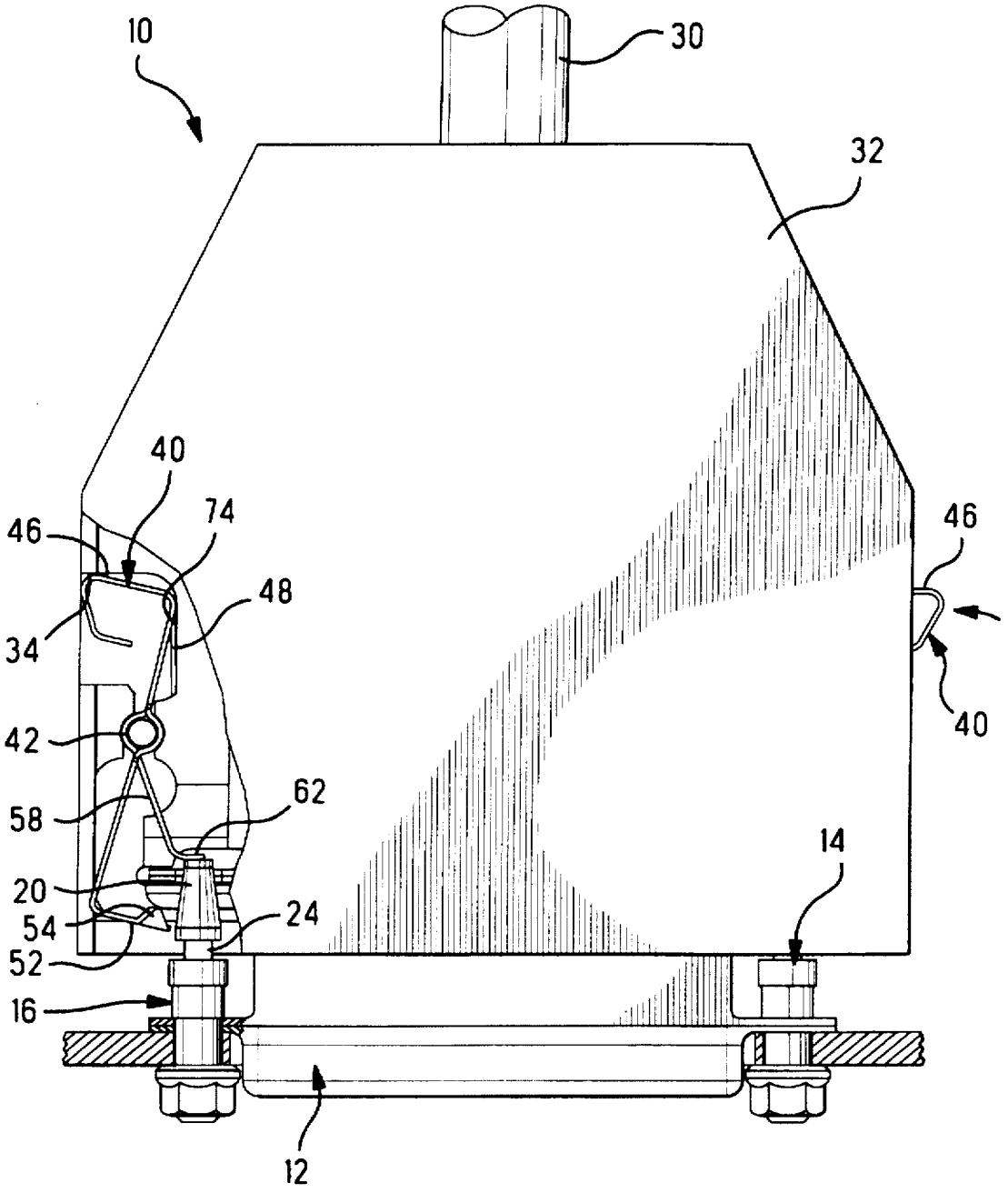
FIG. 4 is a partially cut away plan view similar to FIG. 3, showing the actuating end of the inventive spring latch depressed to release the engagement end of the spring latch from the latch post.

As shown in FIG. 4, when it is desired to separate the connectors 12, 26, the operator presses the actuating end 46 of each of the spring latches 40 inwardly against the biasing force of the spring arm 48. This causes the engagement end 52 to pivot outwardly and release the respective latch post 14, 16. At the same time, the spring arm 58 provides an outwardly directed force to the forward end of the latch post 14, 16 to aid in separating the connectors 12, 26.

Accordingly, there has been disclosed an improved unitary spring latch for latching an electrical connector assembly to a mating connector and for assisting in the unlatching therefrom. While a preferred embodiment of the present invention has been disclosed herein, it is understood that various modifications and adaptations to the disclosed embodiment will be apparent to one of ordinary skill in the art and it is intended that this invention be limited only by the scope of the appended claims.

What is claimed is:

1. An electrical connector assembly adapted for mating connection with a mating connector having a latch post extending along the direction of relative linear movement between the connector assembly and the mating connector during mating/unmating, the latch post having an enlarged head at its forward end, the assembly comprising:

a primary connector supporting a plurality of electrical terminals exposed along a mating face of the primary connector;

a two-part housing with an interior cavity adapted to encircle and contain the primary connector with the primary connector mating face being accessible from outside the housing along a forward end of the housing, the housing further having an interior cavity open to said housing forward end for receiving thereinto a latch post along each side of the primary connector; and a unitary spring latch associated with each latch post and supported within said housing for pivotal movement about a pivot axis orthogonal to said direction of relative linear movement, each spring latch including:

an engagement end extending into said latch post receiving cavity and adapted for engagement with the latch post behind the enlarged head;

an actuating end across said pivot axis from said engagement end and extending outwardly from said housing, said actuating end adapted for inward pivoting movement to release said engagement end from engagement with said latch post;

biasing means for yieldably biasing said actuating end outwardly from said housing; and a spring arm extending into said latch post receiving cavity and adapted to bear against the forward end of said latch post and provide a yieldable biasing force to said latch post in a direction outwardly from said latch post receiving cavity, to aid ejection of said latch post from said latch post receiving cavity.

2. The assembly according to claim 1 wherein said latch post has a reduced width shaft portion behind said enlarged head and said spring latch engagement end includes a pair of spaced fingers extending substantially orthogonally to the longitudinal axis of said latch post, with the spacing between said pair of spaced fingers being greater than the width of said reduced width shaft portion and less than the width of said enlarged head and with said pair of spaced fingers being on opposite sides of a plane including the longitudinal axis of said latch post.

3. The assembly according to claim 2 wherein said latch post enlarged head tapers outwardly from said latch post forward end toward said reduced width shaft portion and said spring latch engagement end is yieldably biased into engagement with said latch post, whereby upon insertion of said latch post into said latch post receiving cavity the taper of the enlarged head is effective to deflect said spring latch engagement end out of the path of said latch post until said pair of spaced fingers are adjacent said reduced width shaft portion so that said engagement end then snaps behind said enlarged head.

4. A unitary spring latch for an electrical connector assembly, the electrical connector assembly adapted for mating connection with a mating connector having a latch post extending along the direction of relative movement between the connector assembly and the mating connector during mating/unmating, the latch post having an enlarged head at its forward end, the electrical connector assembly having a primary connector supporting a plurality of electrical terminals exposed along a mating face of the primary connector, a two-part housing with an interior cavity adapted to encircle and contain the primary connector with the primary connector mating face being accessible from outside the housing along a forward end of the housing, the housing further having an interior cavity open to said housing forward end for receiving thereinto a latch post along each side of the primary connector, the unitary spring latch adapted for support within said housing for pivotal movement about a pivot axis orthogonal to said direction of relative movement, the spring latch comprising:

an engagement end extending into said latch post receiving cavity and adapted for engagement with the latch post behind the enlarged head;

an actuating end across said pivot axis from said engagement end and extending outwardly from said housing, said actuating end adapted for inward pivoting movement to release said engagement end from engagement with said latch post;

biasing means for yieldably biasing said actuating end outwardly from said housing; and a spring arm extending into said latch post receiving cavity and adapted to bear against the forward end of said latch post and provide a yieldable biasing force to said latch post in a direction outwardly from said latch post receiving cavity, to aid ejection of said latch post from said latch post receiving cavity.

5. The spring latch according to claim 4 wherein said latch post has a reduced width shaft portion behind said enlarged head and said spring latch engagement end includes a pair of spaced fingers extending substantially orthogonally to the longitudinal axis of said latch post, with the spacing between said pair of spaced fingers being greater than the width of said reduced width shaft portion and less than the width of said enlarged head and with said pair of spaced fingers being on opposite sides of a plane including the longitudinal axis of said latch post.

6. The spring latch according to claim 5 wherein said latch post enlarged head tapers outwardly from said latch post forward end toward said reduced width shaft portion and said spring latch engagement end is yieldably biased into engagement with said latch post, whereby upon insertion of said latch post into said latch post receiving cavity the taper of the enlarged head is effective to deflect said spring latch engagement end out of the path of said latch post until said pair of spaced fingers are adjacent said reduced width shaft portion so that said engagement end then snaps behind said enlarged head.

* * * * *